US010995553B2

(12) United States Patent
Wheeler

(10) Patent No.: US 10,995,553 B2
(45) Date of Patent: May 4, 2021

(54) SHAFT DEFLECTOR WITH A DEFLECTION ADJUSTING MECHANISM

(71) Applicant: Halliburton Energy Services, Inc., Houston, TX (US)

(72) Inventor: Fraser A. Wheeler, Edmonton (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/487,283

(22) PCT Filed: May 31, 2017

(86) PCT No.: PCT/CA2017/050663
§ 371 (c)(1),
(2) Date: Aug. 20, 2019

(87) PCT Pub. No.: WO2018/218330
PCT Pub. Date: Dec. 6, 2018

(65) Prior Publication Data

US 2020/0056429 A1 Feb. 20, 2020

(51) Int. Cl.
*E21B 7/06* (2006.01)
*E21B 4/02* (2006.01)

(52) U.S. Cl.
CPC ..... *E21B 7/062* (2013.01); *E21B 7/068* (2013.01); *E21B 4/02* (2013.01)

(58) Field of Classification Search
CPC ..... E21B 7/062; E21B 7/068; E21B 4/02
See application file for complete search history.

(56) References Cited

U.S. PATENT DOCUMENTS 6,092,610 A 7/2000 Kosmala et al.
6,769,499 B2 8/2004 Cargill et al.
6,837,315 B2 1/2005 Pisoni et al.
(Continued)

FOREIGN PATENT DOCUMENTS

WO 2014182303 A1 11/2014
WO 2015089620 A1 6/2015
(Continued)

OTHER PUBLICATIONS

Schlumberger, "PowerDrive Xceed", Product Sheet available at https://www.slb.com/-/media/files/drilling/product-sheet/powerdrive-xceed-ps, 2017 (2 pages).

*Primary Examiner* — David J Bagnell
*Assistant Examiner* — Yanick A Akaragwe
(74) *Attorney, Agent, or Firm* — Parlee McLaws LLP; Angela Keuling; Craig W. Roddy

(57) ABSTRACT

An apparatus including a housing defining a housing bore and a shaft extending within the housing bore. The shaft is deflectable and tillable within the housing bore. The apparatus further includes a fulcrum for tiltably supporting the shaft within the housing bore, a shaft deflector contained within the housing for providing a deflection of the shaft within the housing bore so that the shaft tilts about the fulcrum, and a deflection adjusting mechanism. The deflection adjusting mechanism includes a biasing device which responds to an external force exerted on the shaft in order to adjust the deflection of the shaft provided by the shaft deflector and thereby provide an adjusted deflection of the shaft.

20 Claims, 7 Drawing Sheets

(56) References Cited

U.S. PATENT DOCUMENTS

| | | | | |
|---|---|---|---|---|
| 9,828,804 | B2 * | 11/2017 | Pearce | E21B 7/067 |
| 2005/0236187 | A1 | 10/2005 | Chen et al. | |
| 2014/0209389 | A1 | 7/2014 | Sugiura et al. | |
| 2016/0090789 | A1 | 3/2016 | Gajji et al. | |
| 2016/0222734 | A1 | 8/2016 | Winslow et al. | |

FOREIGN PATENT DOCUMENTS

| | | | |
|---|---|---|---|
| WO | 2015139108 | A1 | 9/2015 |
| WO | 2017087490 | A1 | 5/2017 |

* cited by examiner

SHAFT DEFLECTOR WITH A DEFLECTION ADJUSTING MECHANISM

TECHNICAL FIELD

An apparatus including a housing, a shaft, a shaft deflector for deflecting the shaft within the housing, and a deflection adjusting mechanism for adjusting the deflection of the shaft in response to an external force exerted on the shaft.

BACKGROUND OF THE INVENTION

In various industries, including the oil and gas industry, an apparatus including a housing and a shaft may include a shaft deflector for deflecting the shaft. Deflection of the shaft may cause the shaft to tilt or otherwise move relative to the housing. In the oil and gas industry, apparatus of this type may be used in a borehole in order to orient the shaft relative to the housing for directional drilling or other purposes. A tilted shaft within a borehole may be exposed to an external force exerted on the shaft by the borehole or by some other source. The external force exerted on the shaft may be proportional to the amount of deflection of the shaft which is provided by the shaft deflector. The magnitude of the external force may affect the reliability of the apparatus.

BRIEF DESCRIPTION OF DRAWINGS

Embodiments of the invention will now be described with reference to the accompanying drawings, in which:

FIGS. 3A and 3B are longitudinal section views depicting additional details of a rotary steerable drilling apparatus of the type depicted in FIG. 2, comprising a shaft deflector and a first exemplary embodiment of a deflection adjusting mechanism, wherein FIG. 3B is a continuation of FIG. 3A.

DETAILED DESCRIPTION

Figure 1:
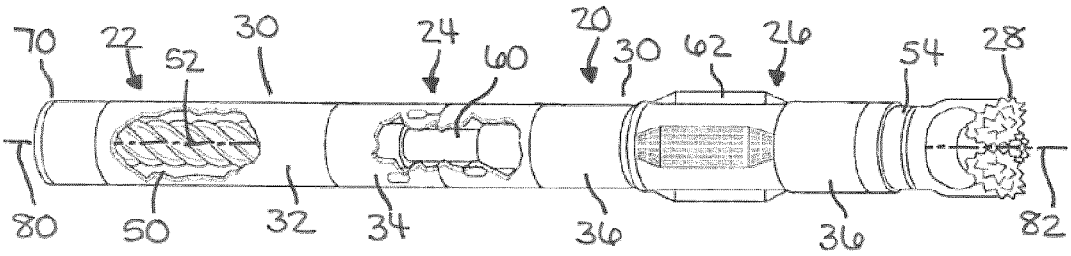
FIG. 1 is a pictorial view of a drilling motor for use in drilling a borehole.

This description is directed, in part, to an apparatus comprising a shaft deflector for deflecting a shaft and a deflection adjusting mechanism for adjusting the deflection of the shaft in response to an external force exerted on the shaft.

The apparatus described herein may be used in any suitable environment and/or for any application in which it is necessary or desirable to deflect a shaft.

As a non-limiting example, the apparatus may be an apparatus which is configured to be inserted in a borehole, in which case the apparatus may be any suitable apparatus which may be inserted in a borehole for any purpose. As non-limiting examples, the apparatus may be an apparatus for use in drilling, completing, servicing, logging or surveying a borehole.

As a particular non-limiting example, the apparatus may be an apparatus for use in drilling a borehole. As non-limiting examples, an apparatus for use in drilling a borehole may comprise, consist, or consist essentially of a drilling motor, a rotary steerable drilling apparatus, a turbine, a reciprocating hammer, or any other apparatus which may be used in drilling a borehole. A rotary steerable drilling apparatus may be a point-the-bit rotary steerable drilling apparatus or a push-the-bit rotary steerable drilling apparatus.

The apparatus may more particularly comprise a housing, a shaft, a shaft deflector and a deflection adjusting mechanism. The apparatus may have a primary axis. The primary axis of the apparatus may be an axis of the housing. The shaft may have a shaft axis. The shaft axis may be an axis of rotation of the shaft.

The housing may define a housing bore. The shaft may define a shaft bore. The shaft may extend within the housing bore. The shaft may be deflectable within the housing bore and/or the shaft may be tiltable within the housing bore. The shaft deflector may be contained within the housing. The shaft deflector may provide a deflection of the shaft within the housing bore. The deflection of the shaft provided by the shaft deflector may cause the shaft to tilt within the housing bore. The apparatus may comprise a fulcrum for tiltably supporting the shaft within the housing bore. The deflection of the shaft provided by the shaft deflector may cause the shaft to tilt about the fulcrum within the housing bore.

The deflection adjusting mechanism adjusts the deflection of the shaft provided by the shaft deflector. The deflection adjusting mechanism may adjust the deflection of the shaft in response to an external force exerted on the shaft in order to provide an adjusted deflection of the shaft.

The external force exerted on the shaft may be any force which may act on the shaft during use of the apparatus. The external force may be exerted on the shaft as a result of the deflection and/or tilting of the shaft within the housing. The external force may be exerted on the shaft in opposition to the deflection and/or tilting of the shaft. As a non-limiting example, the deflection and/or tilting of a shaft within a drilling apparatus may result in a reaction force being exerted by a borehole or by some other source on a portion of the shaft which extends from the housing. In such circumstances, as a non-limiting example, the external force exerted on the shaft may comprise, consist of, or consist essentially of an external lateral force.

The deflection adjusting mechanism may be actuated manually, automatically or semi-automatically in order to adjust the deflection of the shaft. Where the deflection adjusting mechanism is actuated manually, the deflection adjusting mechanism may be configured to respond indirectly to an external force acting on the shaft. As a non-limiting example, the apparatus may provide a signal to an operator of the apparatus in response to an external force, and the operator may manually actuate the deflection adjusting mechanism in response to the signal. Where the deflection adjusting mechanism is actuated automatically, the deflection adjusting mechanism may be configured to respond directly to an external force acting on the shaft without any intervention or input from an operator of the apparatus. Where the deflection adjusting mechanism is actuated semi-automatically, the deflection adjusting mechanism may be configured to respond to an external force acting on the shaft with a combination of manual and automatic operations.

The deflection of the shaft provided by the shaft deflector and the adjusted deflection provided by the deflection adjusting mechanism may be any type of deflection and in any direction which is required for the operation of the apparatus. As a non-limiting example, the deflection and the adjusted deflection may both comprise, consist of, or consist essentially of a lateral deflection. A lateral deflection may be a deflection which is generally or substantially transverse to the shaft axis. As a particular non-limiting example, the shaft deflector may provide a lateral deflection of the shaft and the deflection adjusting mechanism may adjust the lateral deflection of the shaft to provide an adjusted lateral deflection of the shaft. As a non-limiting example, the deflection adjusting mechanism may adjust a lateral deflection of the shaft in response to an external lateral force exerted on the shaft.

The shaft deflector may be configured to be actuatable to provide an adjustable deflection of the shaft within the housing during assembly and/or use of the apparatus, or the shaft deflector may be configured to provide a fixed deflection of the shaft within the housing.

The apparatus may comprise a deflection bearing between the shaft deflector and the shaft for rotatably supporting the shaft within the shaft deflector. The deflection bearing may comprise, consist of, or consist essentially of one or more suitable bearings or combination of bearings which is capable of rotatably supporting the shaft within the shaft deflector. As non-limiting examples, the deflection bearing may comprise one or more roller bearings or plain bearings which may be configured as radial bearings or as a combination of radial bearings and thrust bearings.

The shaft may extend within the housing bore such that the shaft is rotatable relative to the housing. If the shaft is rotatable relative to the housing, the apparatus may comprise a shaft bearing between the housing and the shaft for rotatably supporting the shaft within the housing. The shaft bearing may comprise, consist of, or consist essentially of one or more suitable bearings or combination of bearings, which may be located at any suitable position or positions on or in the apparatus. As non-limiting examples, the shaft bearing may comprise one or more roller bearings or plain bearings which may be configured as radial bearings or as a combination of radial bearings and thrust bearings, such as one or more radial bearings between the housing and the shaft and/or one or more fulcrum bearings between the fulcrum and the shaft.

Alternatively, the shaft may be connected with the housing such that the shaft is rotatable with the housing. If the shaft is rotatable with the housing, the apparatus may comprise a shaft deflector bearing between the housing and the shaft deflector for rotatably supporting the shaft deflector within the housing. The shaft deflector bearing may comprise, consist of, or consist essentially of one or more suitable bearings or combination of bearings, which may be located at any suitable position or positions on or in the apparatus. As non-limiting examples, the shaft deflector bearing may comprise one or more roller bearings or plain bearings which may be configured as radial bearings or as a combination of radial bearings and thrust bearings.

The shaft deflector may deflect the shaft in any suitable manner. As a non-limiting example, the shaft deflector may be configured to be actuatable during assembly and/or use of the apparatus to move in any suitable manner which is capable of providing a suitable deflection of the shaft. As non-limiting examples, the shaft deflector may be configured to move laterally, longitudinally and/or rotationally in order to provide a deflection of the shaft, such as a lateral deflection of the shaft. Alternatively, the shaft deflector may be configured to provide a fixed deflection of the shaft which is set during fabrication or assembly of the drilling apparatus.

The shaft deflector or one or more components of the shaft deflector may act directly or indirectly on the deflection bearing in order to provide a deflection of the shaft. As a non-limiting example, the shaft deflector may move the deflection bearing in order to provide a deflection of the shaft. The movement of the deflection bearing may be any movement which is capable of providing a deflection of the shaft. As a non-limiting example, the shaft deflector may move the deflection bearing laterally in order to provide a lateral deflection of the shaft.

The shaft deflector may comprise, consist of, or consist essentially of any suitable structure, device and/or apparatus which is capable of deflecting the shaft. As a non-limiting example, the shaft deflector may comprise a cam for providing the deflection of the shaft. The deflection bearing may be engaged with the cam either directly or indirectly so that the deflection bearing is moved by the cam as the cam performs its camming function.

The cam may comprise, consist of, or consist essentially of any suitable structure, device and/or apparatus which is capable of performing a camming function. As a non-limiting example, the cam may comprise a sloped ramp surface. The cam may be movable in order to deflect the shaft and/or to adjust the deflection of the shaft. As non-limiting examples, the ramp surface of the cam may be sloped longitudinally relative to the shaft axis so that moving the cam longitudinally may deflect the shaft and/or adjust the deflection of the shaft, or the ramp surface of the cam may be sloped circumferentially relative to the circumference of the shaft so that rotating the cam may deflect the shaft and/or adjust the deflection of the shaft. The cam may be movable within the shaft deflector in order to deflect the shaft and/or adjust the deflection of the shaft, or components of the shaft deflector including the cam may move as a unit in order to deflect the shaft and/or adjust the deflection of the shaft.

The shaft deflector may comprise a shaft deflector housing. The cam may be positioned entirely or partially within the shaft deflector housing. The cam may be movable within the shaft deflector housing in order to deflect the shaft and/or adjust the deflection of the shaft, or the cam may be movable with the shaft deflector housing in order to deflect the shaft and/or adjust the deflection of the shaft.

The shaft deflector may comprise a shaft deflector actuator for actuating the shaft deflector. The shaft deflector actuator may comprise, consist of, or consist essentially of any suitable structure, device and/or apparatus capable of causing the movement which is required to cause the shaft deflector to provide the deflection of the shaft. As non-limiting examples, the shaft deflector actuator may cause the shaft deflector housing and/or the cam to move laterally, longitudinally and/or radially in order to provide the deflection of the shaft. As a particular non-limiting example, the shaft deflector actuator may cause both the shaft deflector housing and the cam to move longitudinally within the apparatus, thereby causing the deflection bearing to move laterally as the ramp surface moves relative to the deflection bearing.

The shaft deflector may comprise a cam drive motor for rotating one or more components of the shaft deflector within the housing in order to provide an orientation of the deflection of the shaft and/or to maintain an orientation of the deflection of the shaft. As non-limiting examples, the cam drive motor may rotate both the shaft deflector housing and the cam relative to the housing of the apparatus or the cam drive motor may rotate the cam relative to the shaft deflector housing. The shaft deflector may comprise a cam drive linkage between the cam drive motor and the one or more components of the shaft deflector to facilitate rotation of the one or more components of the shaft deflector by the cam drive motor.

The functions of the shaft deflector actuator and the cam drive motor may be performed by separate drive mechanisms or the functions may be combined into a single drive mechanism.

The deflection adjusting mechanism may adjust the deflection of the shaft in any suitable manner. As non-limiting examples, the deflection adjusting mechanism may move the cam directly or indirectly in order to adjust the deflection of the shaft, the deflection adjusting mechanism may move one or more other components of the shaft deflector directly or indirectly in order to adjust the deflection of the shaft, or the deflection adjusting mechanism may move the deflection bearing directly or indirectly in order to adjust the deflection of the shaft.

The deflection adjusting mechanism may comprise, consist of, or consist essentially of any suitable structure, device and/or apparatus which is capable of cooperating with the shaft deflector to adjust the deflection of the shaft provided by the shaft deflector in response to an external force exerted on the shaft, and thereby provide an adjusted deflection of the shaft. The deflection adjusting mechanism may be configured so that the deflection adjusting mechanism causes the deflection of the shaft to decrease as the external force exerted on the shaft increases and/or causes the deflection of the shaft to increase as the external force exerted on the shaft decreases. The deflection adjusting mechanism may be configured so that the adjusted deflection of the shaft fluctuates as the external force exerted on the shaft fluctuates.

As a non-limiting example, the deflection adjusting mechanism may comprise a biasing device which responds to the external force exerted on the shaft by providing a biasing force in opposition to the external force. The biasing device may comprise, consist of, or consist essentially of any suitable structure, device and/or apparatus including, as non-limiting examples, a suitable spring, a suitable resilient material, and/or a suitable compressible fluid device. As non-limiting examples, a suitable spring may be a coil spring, a leaf spring, a Belleville spring, or a torsion spring. As non-limiting examples, a suitable resilient material may be a rubber or an elastomer material. As non-limiting examples, a suitable compressible fluid device may comprise a pneumatic or hydraulic device such as a shock absorber device.

Where the deflection adjusting mechanism comprises a resilient material as a biasing device, the resilient material may in some circumstances be capable of providing a sealing function to the shaft deflector and/or to the deflection adjusting mechanism in addition to a deflection adjusting function.

The deflection adjusting mechanism may provide an adjustment range for the adjusted deflection of the shaft. The adjustment range may extend between a minimum adjusted deflection and a maximum adjusted deflection. Where the deflection adjusting mechanism comprises a biasing device, the adjustment range, the minimum adjusted deflection and the maximum adjusted deflection may be dependent at least in part upon a range of travel of the biasing device. The apparatus may comprise one or more adjustment limiters for defining and/or limiting the adjustment range, which may comprise, consist of, or consist essentially of any suitable structure, device and/or apparatus. As a non-limiting example, an adjustment limiter may comprise one or more stops for limiting the movement of the shaft deflector, the deflection adjustment mechanism, or the cam beyond the minimum adjusted deflection and/or the maximum adjusted deflection. The deflection adjusting mechanism may be configured so that the deflection of the shaft decreases within the adjustment range as the external force exerted on the shaft increases.

The deflection adjusting mechanism may be configured to provide a movement in any suitable direction in order to adjust the deflection of the shaft in response to an external force exerted on the shaft. As non-limiting examples, the deflection adjusting mechanism may be configured to provide a lateral, longitudinal and/or rotational movement of the cam in response to the external force exerted on the shaft, in order to adjust the deflection of the shaft.

As more particular non-limiting examples, the deflection adjusting mechanism may move the cam laterally in response to an external lateral force exerted on the shaft, thereby moving the deflection bearing laterally in order to adjust the deflection of the shaft, or the deflection adjusting mechanism may move the cam longitudinally in response to an external lateral force exerted on the shaft, thereby moving the deflection bearing laterally in order to adjust the deflection of the shaft.

Where the deflection adjusting mechanism moves the cam laterally, the deflection adjusting mechanism may comprise a biasing device such as a spring or a resilient material interposed radially between the shaft deflector housing and the cam which responds to the external force exerted on the shaft and causes the cam to move laterally relative to the shaft deflector housing.

Where the deflection adjusting mechanism moves the cam longitudinally, the deflection adjusting mechanism may comprise a biasing device such as a spring or a resilient material interposed longitudinally between the shaft deflector housing and the cam which responds to the external force exerted on the shaft and causes the cam to move longitudinally relative to the shaft deflector housing.

Where the deflection adjusting mechanism moves the cam longitudinally, the deflection adjusting mechanism alternatively may comprise a biasing device such as a spring or a resilient material interposed longitudinally between the shaft deflector housing and another component of the apparatus which responds to the external force exerted on the shaft and causes the shaft deflector housing and the cam to move longitudinally within the apparatus. In such circumstances, the biasing device may be interposed longitudinally between the shaft deflector housing and any other component of the apparatus which will enable the shaft deflector housing and the cam to move longitudinally within the apparatus. As non-limiting examples, the biasing device may be interposed longitudinally between the shaft deflector housing and the housing, between the shaft deflector housing and the shaft, or between the shaft deflector housing and a component of the shaft deflector such as the cam drive motor.

Where the apparatus is an apparatus for use in drilling a borehole, the housing and the shaft may each be connectable directly or indirectly with other structures, devices or apparatus which may also be used in drilling a borehole. As non-limiting examples, such other structures, devices or apparatus may comprise, consist of, or consist essentially of drill pipe, drill collars, logging-while-drilling tools, measurement-while-drilling tools, stabilizers, reamers, and drill bits.

Where the apparatus is a rotary steerable drilling apparatus, the housing may or may not be connected directly or indirectly with a drill string, and the shaft may or may not be directly or indirectly connected with a drill bit.

As a non-limiting example of a rotary steerable drilling apparatus, the housing may be connected with a drill string and the shaft may be connected with a drill bit and with the housing so that the shaft is rotatable with the housing, with the result that rotation of the drill string causes rotation of the housing, the shaft and the drill bit. In such circumstances, the shaft deflector may be rotatable relative to both the housing and the shaft, and may be configured to rotate relative to the housing so that the shaft deflector is substantially geostationary.

As an alternate non-limiting example of a rotary steerable drilling apparatus, the shaft may be connected with a drill string and with a drill bit so that the shaft and the drill bit are rotatable with the drill string, and the housing may be a non-rotating housing which is rotatable relative to the shaft and is configured to remain substantially geostationary. In such circumstances, the shaft deflector may be connected with the housing so that the shaft deflector does not rotate relative to the housing.

Where the apparatus is a drilling motor, the housing may or may not be connected directly or indirectly with a drill string, and the shaft may or may not be directly or indirectly connected with a drill bit.

As a non-limiting example of a drilling motor, the housing may comprise or may be connected with a stator of a drilling motor and the shaft may comprise or be connected with a rotor of a drilling motor and with a drill bit so that the shaft is rotatable relative to the drill string and the housing. In such circumstances, the shaft deflector may be connected with the housing so that the shaft deflector does not rotate relative to the housing.

FIGS. 1-10 are exemplary only. The shaft deflector and the deflection adjusting mechanism described herein may be used in any suitable apparatus and in any suitable application.

In the description of the exemplary embodiments which follows, features which are identical or equivalent in the exemplary embodiments may be identified with the same reference numbers.

Referring to FIG. 1, an exemplary drilling motor (20) as a drilling apparatus for use in drilling a borehole comprises a power section (22) and a bearing section (26). The bearing section (26) is axially distal to the power section (22). One or more sections of the drilling motor (20) may be axially interposed between the power section (22) and the bearing section (26). As depicted in FIG. 1, the drilling motor (20) further comprises a transmission section (24) which is axially interposed between the power section (22) and the bearing section (26). These sections of the drilling motor (20) constitute components of a powertrain which utilizes fluid energy to rotate a drill bit (28). A drill string (70) is connected with the proximal end of the power section (22). Fluid is passed through the drill string (70), the drilling motor (20) and the drill bit (28) in order to drive the drilling motor (20), cool the components of the drilling motor (20), and flush cuttings which are generated by the drill bit (28).

The sections of the drilling motor (20) are contained within a tubular housing (30).

As depicted in FIG. 1, the housing (30) comprises a plurality of housing sections connected together with threaded connections, including a tubular power housing (32) for the power section (22), a tubular transmission housing (34) for the transmission section (24), and a tubular bearing housing (36) for the bearing section (26).

The power housing (32) may comprise a plurality of power housing components which together provide the power housing (32), or the power housing (32) may be a unitary power housing (32) which is formed from a single power housing component.

The transmission housing (34) may comprise a plurality of transmission housing components which together provide the transmission housing (34), or the transmission housing (34) may be a unitary transmission housing (34) which is formed from a single transmission housing component.

The bearing housing (36) may comprise a plurality of bearing housing components which together provide the bearing housing (36), or the bearing housing (36) may be a unitary bearing housing (36) which is formed from a single bearing housing component.

The power section (22) of the drilling motor (20) comprises a stator (50) and a rotor (52). The stator (50) is fixedly connected with the power housing (32), and the rotor (52) is rotatable within the stator (50) in response to fluid circulating through the power section (22).

As depicted in FIG. 1, the power section (22) is a Moineau-type power section in which the stator (50) and the rotor (52) are lobed. The rotor (52) has one fewer lobe than the stator (50), and rotates eccentrically within the stator (50).

The transmission section (24) accommodates and converts the eccentric movement of the rotor (52) to concentric rotation of a driveshaft (54) within the bearing section (26). The transmission section (24) also transmits rotational drive energy from the power section (22) to the bearing section (26).

As depicted in FIG. 1, the transmission section (24) comprises the transmission housing (34) and a transmission member or transmission shaft (60) which is connected between the rotor (52) and the driveshaft (54) such that eccentric rotation of the rotor (52) results in concentric rotation of the transmission shaft (60), and rotation of the transmission shaft (60) causes rotation of the driveshaft (54).

As depicted in FIG. 1, the bearing section (26) comprises the bearing housing (36), the driveshaft (54) and a bearing assembly (not shown) comprising one or more thrust bearings and radial bearings which rotatably support the driveshaft (54) within the housing (30). As depicted in FIG. 1, the bearing section (26) also comprises a stabilizer (62) which is threadably connected with the exterior of the bearing housing (36).

As depicted in FIG. 1, the drill bit (28) is connected directly or indirectly with the distal end of the driveshaft (54) so that rotation of the driveshaft (54) causes rotation of the drill bit (28).

In the exemplary drilling motor (20) depicted in FIG. 1, a seal assembly (not shown) is contained within the housing (30) adjacent to the distal end of the housing (30).

The drilling motor (20) has a primary axis (80) and the driveshaft (54) has a driveshaft axis (82). As depicted in FIG. 1, the primary axis (80) is the axis of the housing (30) and the driveshaft axis (82) is the axis of rotation of the shaft (54). As depicted in FIG. 1, the driveshaft axis (82) is oblique to the primary axis (80) so that there is a "bend" in the drilling motor (20).

The drilling motor (20) comprises a shaft deflector (not shown in FIG. 1), which provides a deflection of the driveshaft (54) within the housing (30) and thereby provides the bend in the drilling motor (20). The drilling motor (20) also comprises a deflection adjusting mechanism (not shown in FIG. 1) which adjusts the deflection of the driveshaft (54) within the housing (30) in response to an external force exerted on the driveshaft (54). The shaft deflector may be a shaft deflector as depicted in FIGS. 4-10 and the deflection adjusting mechanism may be a deflection adjusting mechanism as depicted in FIGS. 4-10.

Figure 2:
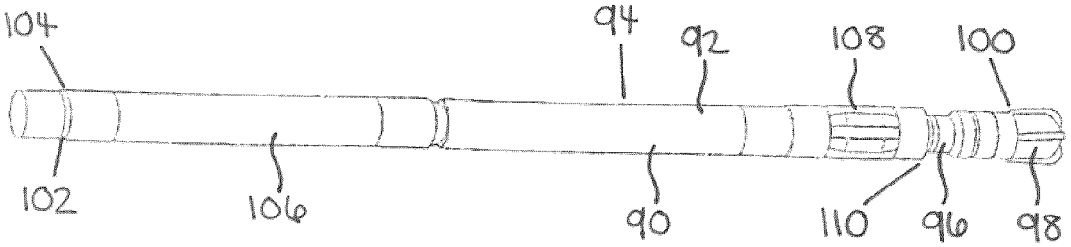
FIG. 2 is a pictorial view of a rotary steerable drilling apparatus for use in drilling a borehole.

Referring to FIG. 2, an exemplary rotary steerable drilling apparatus (90) for use in drilling a borehole comprises a housing (92) having an exterior (94). A shaft (96) extends through and is connected with the housing (92). As depicted in FIG. 2, the drilling apparatus (90) is a continuously rotating, fully rotating, or geostationary type of rotary steerable drilling apparatus in which the shaft (96) is connected with the housing (92) such that the shaft (96) is rotatable with the housing (92).

A drill bit (98) is connected directly or indirectly with a distal end (100) of the shaft (96) and a drill string (102) is connected directly or indirectly with a proximal end (104) of the housing (92). The drill string (102) may include a drill string communication system (106) such as a measurement-while-drilling system. A near-bit stabilizer (108) may be connected with or integrated into the housing (92) adjacent to a distal end (110) of the housing (92). Fluid is passed through the drill string (102), the housing (92), the shaft (96), and the drill bit (98) in order to cool the components of the drilling apparatus (90) and flush cuttings which are generated by the drill bit (98).

A seal assembly (not shown in FIG. 2) is contained within the housing (92) adjacent to the distal end (110) of the housing (92). The seal assembly provides a seal between the shaft (96) and the housing (92) as the shaft (96) bends and/or tilts within the housing (92).

A shaft deflector (not shown in FIG. 2) is contained within the housing (92). In the drilling apparatus (90) depicted in FIG. 2, the shaft deflector is actuatable to cause a deflection of the shaft (96) within the housing (92) during assembly and/or use of the drilling apparatus (90). In other embodiments, the shaft deflector may be configured to provide a fixed deflection of the shaft (96) within the housing (92), which may be set during fabrication or assembly of the drilling apparatus (90). The deflection of the shaft (96) may result in bending of the shaft (96) within the housing (92). Additionally or alternatively, the deflection of the shaft (96) may result in tilting of the shaft (96) within the housing (92).

A deflection adjusting mechanism (not shown in FIG. 2) is also contained within the housing (92).

Figure 3A:
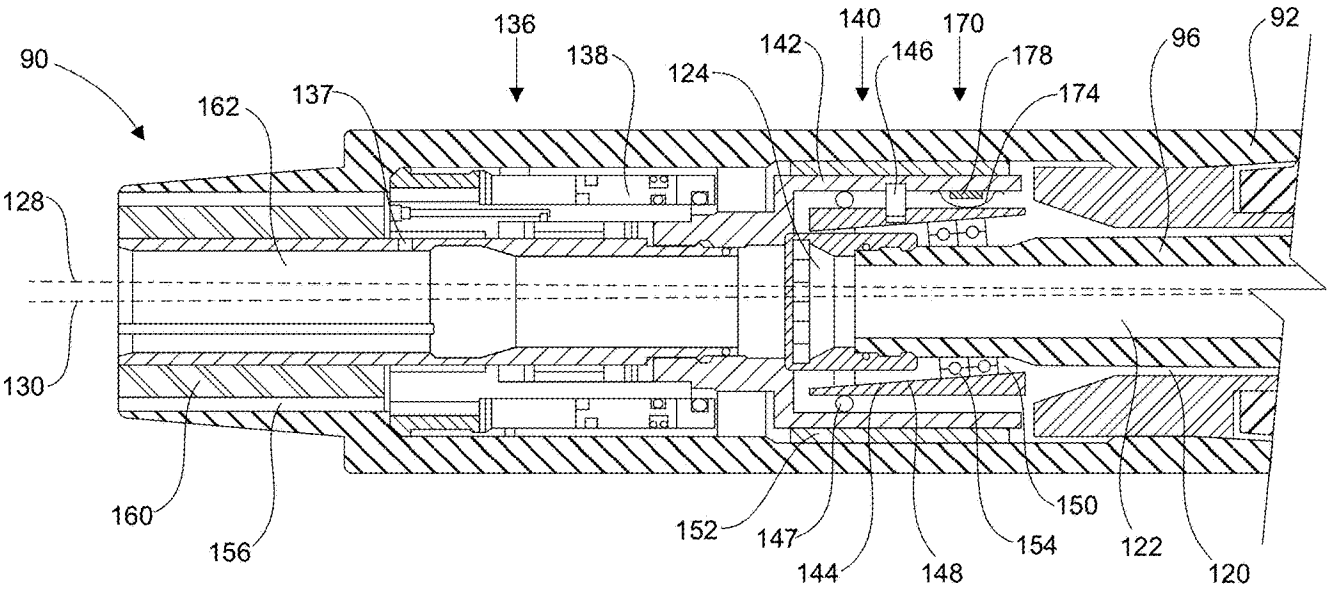
Figure 3B:
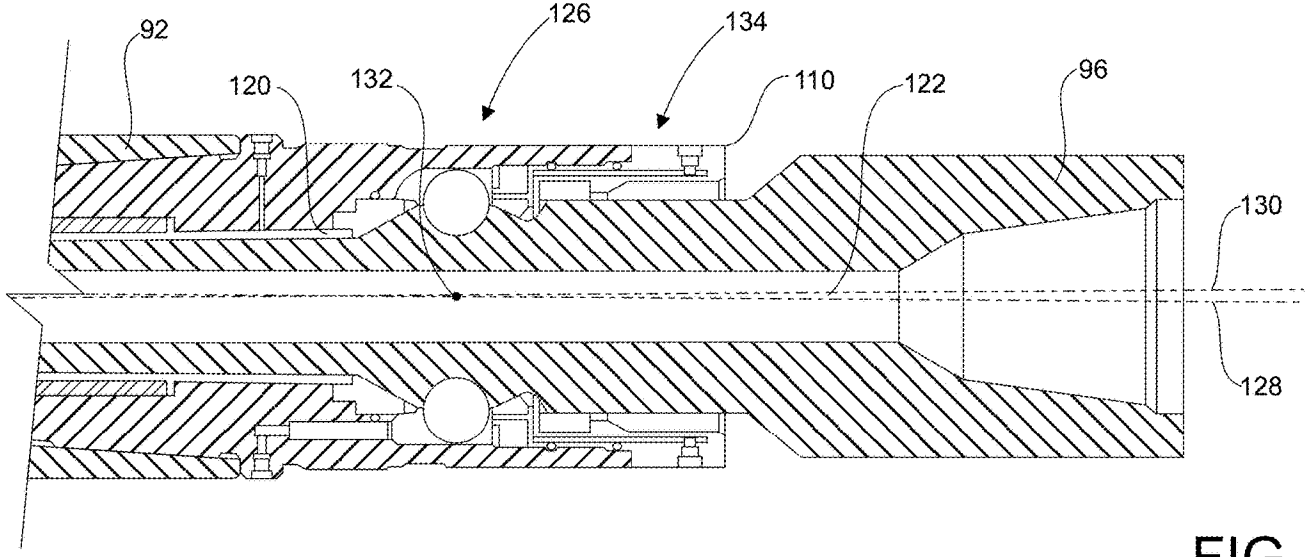
Figure 4:
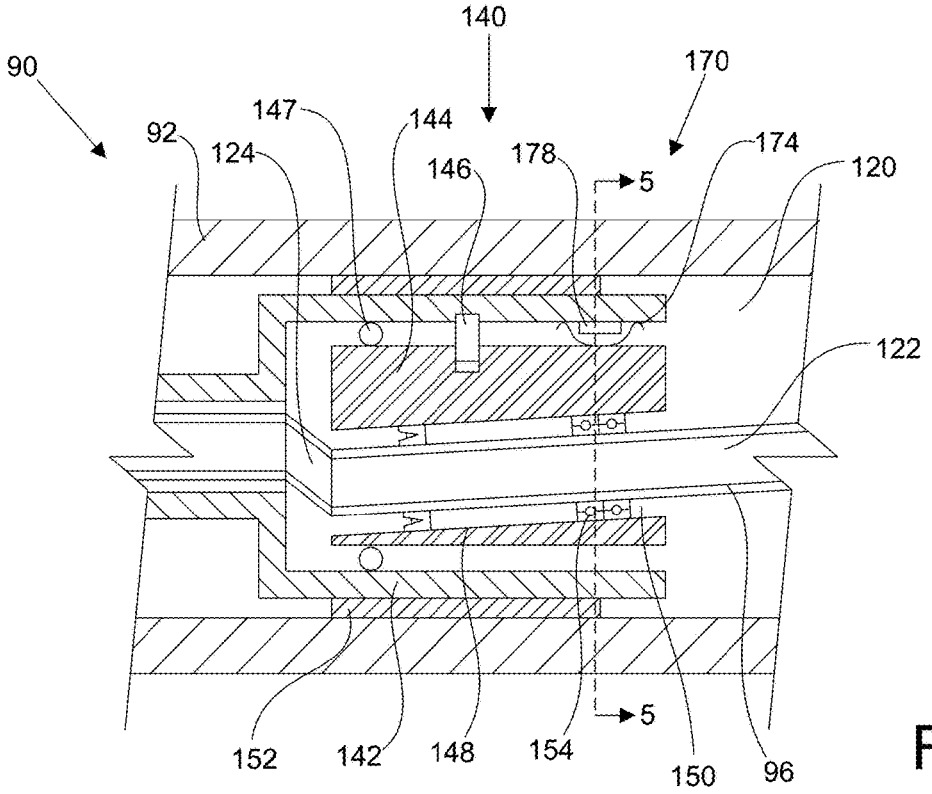
FIG. 4 is a longitudinal section schematic view depicting in more detail the first exemplary embodiment of the deflection adjusting mechanism which is depicted in FIGS. 3A and 3B, wherein the deflection adjusting mechanism comprises a spring as a biasing device, interposed radially between a shaft deflector housing and a cam.
Figure 5A:
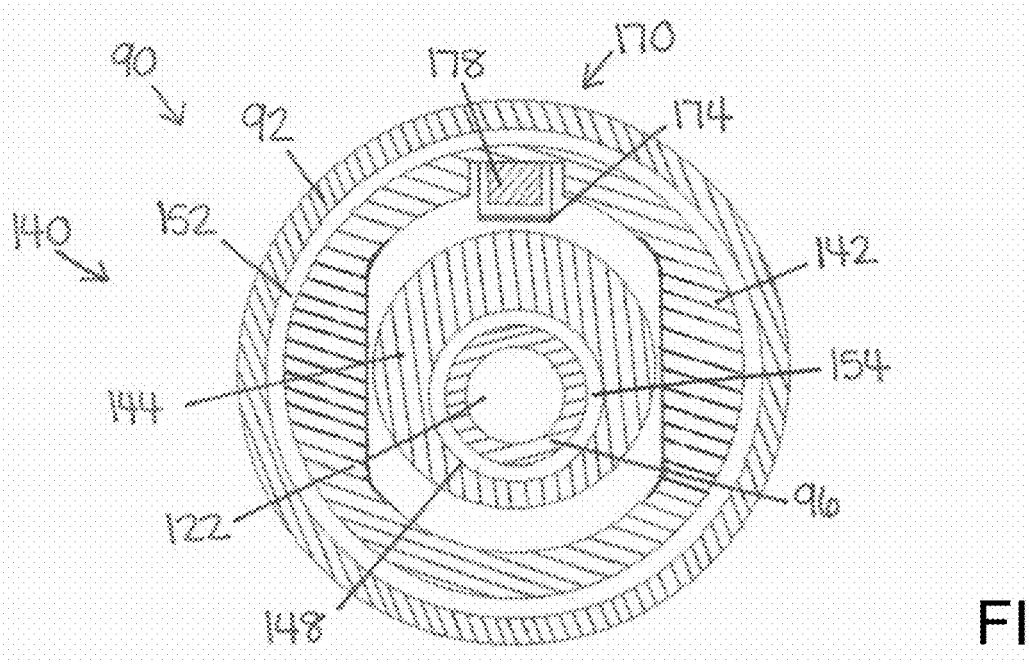
FIGS. 5A-5C are transverse section views of variations of the first exemplary embodiment of the deflection adjusting mechanism depicted in FIG. 4, each taken along line 5-5 of FIG. 4.
Figure 5B:
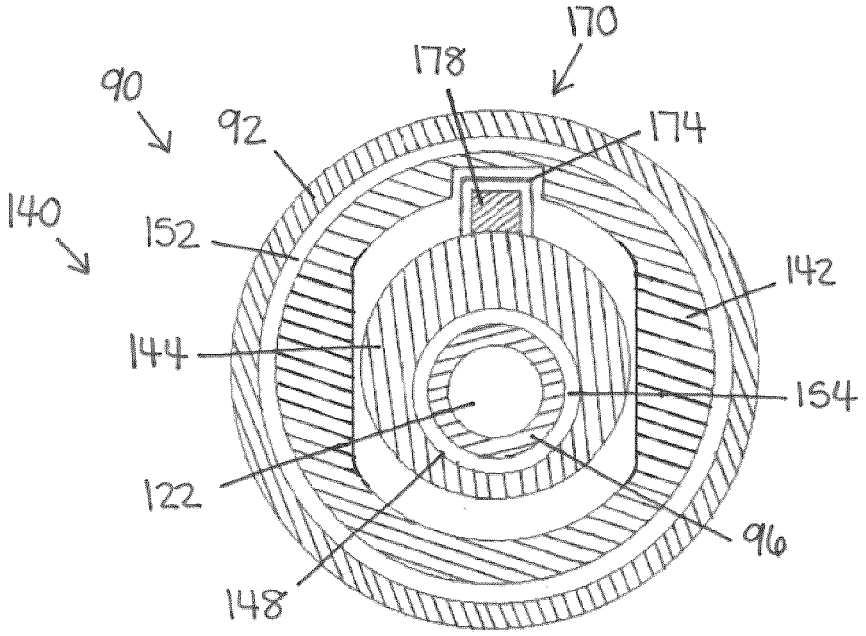
Figure 5C:
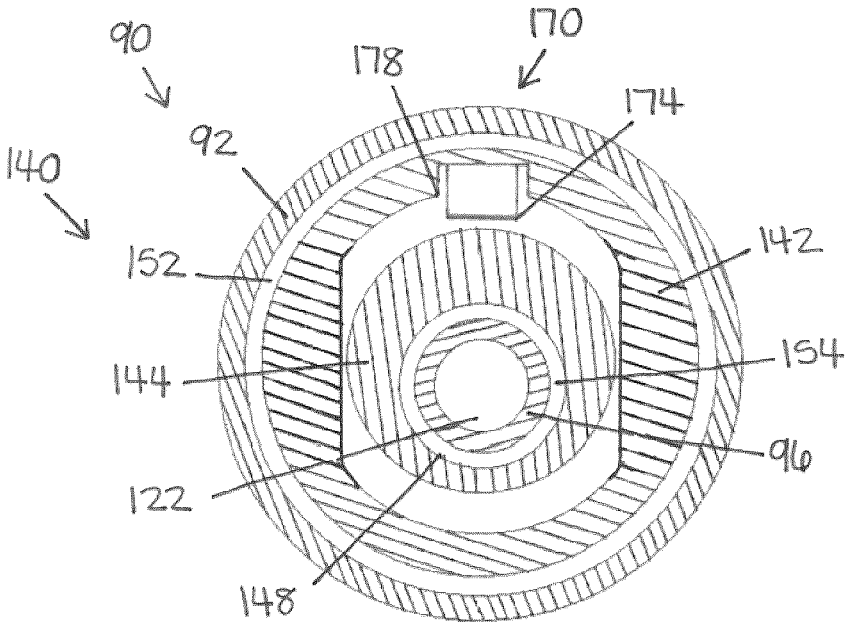

FIGS. 3A and 3B depict additional features of a rotary steerable drilling apparatus (90) of the type depicted in FIG. 2, including a shaft deflector (140) and a first exemplary embodiment of a deflection adjusting mechanism (170), wherein FIG. 3B is a continuation of FIG. 3A. FIG. 4 depicts in more detail the first exemplary embodiment of the deflection adjusting mechanism (170) which is depicted in FIGS. 3A and 3B. FIGS. 5A-5C depict variations of the first exemplary embodiment of the deflection adjusting mechanism (170) of FIG. 4. FIGS. 6-10 depict second, third, fourth, fifth and sixth exemplary embodiments respectively of a deflection adjusting mechanism (170) for use in the drilling apparatus (90) depicted in FIGS. 3A and 3B.

Referring to FIGS. 3A and 3B, the drilling apparatus (90) comprises the housing (92) and the shaft (96). The housing (92) defines a housing bore (120). The shaft (96) extends within the housing bore (120) and is both deflectable and tiltable within the housing bore (120). The shaft (96) defines a shaft bore (122). The shaft (96) comprises a joint (124) which facilitates the deflection of the shaft (96) within the housing bore (120). The drilling apparatus (90) comprises a fulcrum (126) which connects the shaft (96) with the housing (92) and facilitates the tilting of the shaft (96) within the housing bore (120). The fulcrum (126) tiltably supports the shaft (96) within the housing bore (120) such that the shaft (96) is rotatable with the housing (92).

The drilling apparatus (90) has a primary axis (128). As depicted in FIGS. 3A-3B, the primary axis (128) is the axis of the housing (92). The shaft (96) has a shaft axis (130). As depicted in FIGS. 3A-3B, the shaft axis (130) is the axis of rotation of the shaft (96) within the housing (92). When the shaft (96) is deflected by the shaft deflector (140), the shaft axis (130) is oblique to the primary axis (128), but intersects the primary axis (128) at an axis intersection point (132), wherein the axis intersection point (132) is located at the axial position of the fulcrum (126).

Referring to FIG. 3B, a seal assembly (134) is contained within the housing (92) adjacent to the distal end (110) of the housing (92). The seal assembly (134) provides a seal between the shaft (96) and the housing (92) as the shaft (96) bends and/or tilts within the housing (92).

Referring to FIG. 3A, the drilling apparatus (90) comprises a pressure balancing device (136) for providing pressure communication between the shaft bore (122) and the housing bore (120). As depicted in FIG. 3A, the pressure balancing device (138) comprises a pressure balancing port (137) and a balancing piston (138).

The shaft deflector (140) is contained within the housing (92) and provides a deflection of the shaft (96) within the housing bore (120) so that the shaft (96) tilts about the fulcrum (126). In the exemplary embodiments, the deflection of the shaft (96) is a lateral deflection. In the exemplary embodiments, the shaft deflector (140) is actuatable to provide an adjustable deflection of the shaft (96) within the housing (92) during assembly and/or use of the drilling apparatus (90).

In the exemplary embodiments, the shaft deflector (140) comprises a shaft deflector housing (142) and a cam (144) for providing the deflection of the shaft (96). The cam (144) is positioned in the shaft deflector housing (142). The cam (144) is connected with the shaft deflector housing (142) with cam retainer (146). The cam retainer (146) connects the cam (144) with the shaft deflector housing (142) so that the cam (144) is rotationally fixed to the shaft deflector housing (142) and is thus rotatable with the shaft deflector housing (142). In some embodiments, the cam retainer (146) may also connect the cam (144) with the shaft deflector housing (142) so that the cam (144) is axially fixed to the shaft deflector housing (142) and is thus axially movable with the shaft deflector housing (142). A cam seal (147) is interposed between the shaft deflector housing (142) and the cam (144).

In the exemplary embodiments, the cam (144) comprises a ramp surface (148) which is sloped longitudinally relative to the shaft axis (130). The cam (144) defines a cam bore (150). The shaft (96) extends through the cam bore (150).

The shaft deflector housing (142) is rotatably supported within the housing (92) by a shaft deflector bearing (152) between the housing (92) and the shaft deflector housing (142). As depicted in FIGS. 3-10, the shaft deflector bearing (152) comprises a plain type radial bearing. The shaft (96) is rotatably supported within the cam bore (150) by a deflection bearing (154) between the cam (144) and the shaft (96). As depicted in FIGS. 3-10, the deflection bearing (154) comprises a double-row roller type bearing which is capable of supporting both radial loads and axial loads. As a result of the shaft deflector bearing (152) and the deflection bearing (154), the housing (92) and the shaft (96) are rotatable relative to the shaft deflector (140).

In the exemplary embodiments, the shaft deflector (140) moves the deflection bearing (154) laterally in order to provide the deflection of the shaft (96). More particularly, in the exemplary embodiments, the deflection bearing (154) is axially fixed relative to the shaft (96) and the cam (144) is axially movable relative to the deflection bearing (152). The deflection bearing (154) is engaged with the ramp surface (148) on the cam (144) such that the ramp surface (148) moves relative to the deflection bearing (154) as a result of axial movement of the cam (144), thereby moving the deflection bearing (154) laterally and in turn causing the shaft (96) to deflect laterally.

The shaft deflector (140) comprises a shaft deflector actuator (156) for axially moving the shaft deflector housing (142) and the cam (144) within the housing (92) in order to actuate the shaft deflector (140) between a position which provides no lateral deflection of the shaft (96) and positions which provide varying amounts of lateral deflection of the shaft (96).

The shaft deflector (140) comprises a cam drive motor (160) for rotating the shaft deflector housing (142) and the cam (144) and a cam drive linkage (162) between the cam drive motor (160) and the shaft deflector housing (142) for connecting the shaft deflector housing (142) with the cam drive motor (160).

In operation of the drilling apparatus (90), the shaft deflector actuator (156) actuates the shaft deflector (140) by axially moving the shaft deflector housing (142) and the cam (144) to provide a desired lateral deflection of the shaft (96), and the cam drive motor (160) rotates the shaft deflector housing (142) and the cam (144) within the housing (92) to provide a desired orientation of the lateral deflection of the shaft (96). Subsequently, as the housing (92) and the shaft (96) are rotated during drilling, the shaft deflector housing (142) and the cam (144) are maintained geostationary by the cam drive motor (160), which rotates the shaft deflector housing (142) and the cam (144) at the same speed but in the opposite direction as the housing (92) and the shaft (96) are rotated.

The drilling apparatus (90) further comprises the deflection adjusting mechanism (170) for adjusting the deflection of the shaft (96) provided by the shaft deflector (140) in response to an external force exerted on the shaft (96), thereby providing an adjusted deflection of the shaft (96). In the exemplary embodiments, the deflection adjusting mechanism (170) automatically adjusts the deflection of the shaft (96) in response to the external force exerted on the shaft (96). In the exemplary embodiments, the deflection adjusting mechanism (170) comprises a biasing device (174) which responds to an external force exerted on the shaft (96), such as an external lateral force. In the exemplary embodiments, the deflection adjusting mechanism (170) causes the deflection of the shaft (96) to decrease within an adjustment range as the external force exerted on the shaft (96) increases and to increase within the adjustment range as the external force exerted on the shaft (96) decreases.

Referring to FIGS. 3A-3B, 4 and 5A-5C, in the first exemplary embodiment of the deflection adjusting mechanism (170), the biasing device (174) comprises a suitable spring interposed radially between the shaft deflector housing (142) and the cam (144) so that the external force exerted on the shaft (96) deforms the spring and causes the cam (144) to move laterally relative to the shaft deflector housing (142), thereby moving the deflection bearing (154) laterally in order to adjust the deflection of the shaft (96) and provide an adjusted deflection of the shaft (96). The spring is selected to provide a desired deformation in response to the magnitude of the external force which is expected to be exerted on the shaft (96) during use of the drilling apparatus (90). In the first exemplary embodiment, the cam retainer (146) connects the cam (144) with the shaft deflector housing (142) so that the cam (144) is both rotationally fixed and axially fixed to the shaft deflector housing (142) but is capable of some radial movement relative to the shaft deflector housing (142), in order to facilitate operation of the biasing device (174).

As depicted in FIGS. 3A-3B, 4 and 5A-5C, the spring is circumferentially positioned directly opposite to the direction of the deflection of the shaft (96) within the housing bore (120) so that the spring is capable of deforming in response to an external lateral force exerted on the shaft (96) by a borehole (not shown) during use of the drilling apparatus (90). In variations of the first exemplary embodiment, one or more springs may be distributed around a greater portion or all of the circumferential space between the shaft deflector housing (142) and the cam (144).

In the first exemplary embodiment, the deflection adjusting mechanism (170) provides an adjustment range for the adjusted deflection of the shaft (96) which extends between a minimum adjusted deflection and a maximum adjusted deflection. The adjustment range is dependent in part upon the range of travel of the spring. In the first exemplary embodiment, the deflection adjusting mechanism (170) comprises an adjustment limiter (178) for limiting the minimum adjusted deflection of the shaft (96). As depicted in FIG. 4, the adjustment limiter (178) comprises a stop interposed between the shaft deflector housing (142) and the cam (144) which prevents over-compression of the spring and which ensures that a minimum amount of deflection of the shaft (96) will be maintained during use of the drilling apparatus (90). As depicted in FIG. 4, the stop is provided on the shaft deflector housing (142), but the stop may alternatively be provided on the cam (144).

Non-limiting variations of the first exemplary embodiment of the deflection adjustment mechanism (170) are depicted in FIGS. 5A-5C. Referring to FIG. 5A, in a first variation the spring and the stop are both mounted in a recess in the shaft deflector housing (142). Referring to FIG. 5B, in a second variation the spring and the stop are both mounted on the cam (142). Referring to FIG. 5C, in a third variation the spring is mounted in a recess in the shaft deflector housing (142) and the adjustment limiter (178) comprises the recess in the shaft deflector housing (142).

Figure 6:
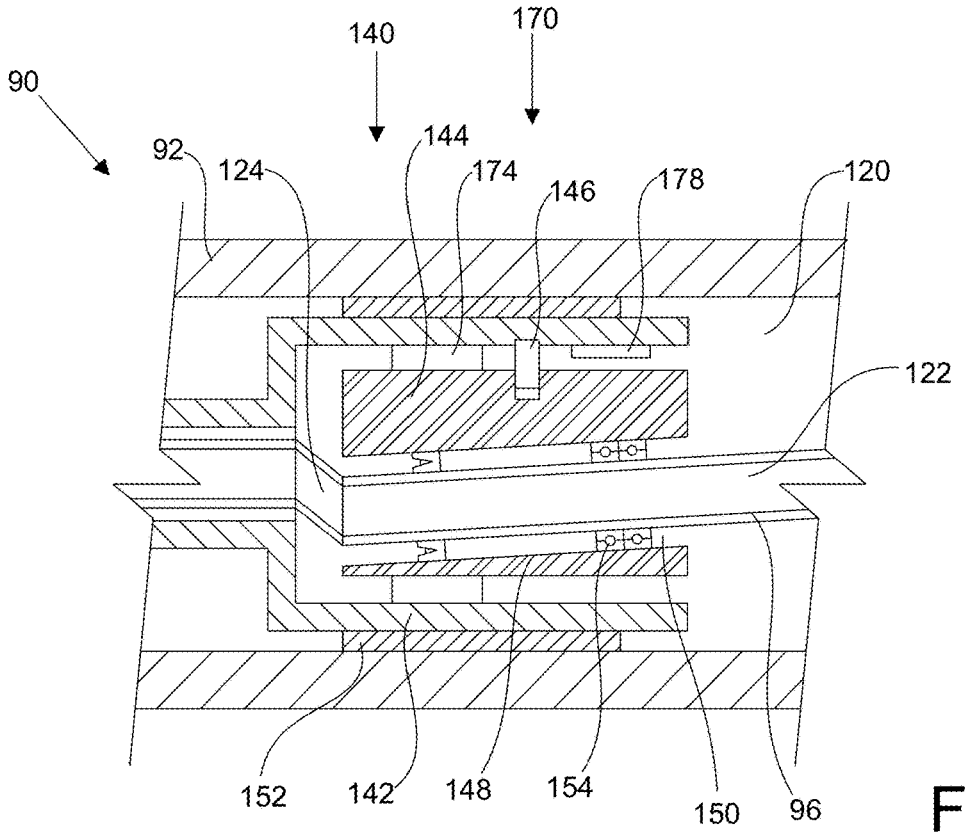
FIG. 6 is a longitudinal section schematic view of a second exemplary embodiment of a deflection adjusting mechanism for use in the drilling apparatus depicted in FIGS. 3A and 3B, wherein the deflection adjusting mechanism comprises a resilient material as a biasing device, interposed radially between a shaft deflector housing and a cam.

Referring to FIG. 6, in the second exemplary embodiment of the deflection adjusting mechanism (170), the biasing device (174) comprises a suitable resilient material interposed radially between the shaft deflector housing (142) and the cam (144) so that the external force exerted on the shaft (96) deforms the resilient material and causes the cam (144) to move laterally relative to the shaft deflector housing (142), thereby moving the deflection bearing (154) laterally in order to adjust the deflection of the shaft (96) and provide an adjusted deflection of the shaft (96). The resilient material is selected to provide a desired deformation in response to the magnitude of the external force which is expected to be exerted on the shaft (96) during use of the drilling apparatus (90). In the second exemplary embodiment, the cam retainer (146) connects the cam (144) with the shaft deflector housing (142) so that the cam (144) is both rotationally fixed and axially fixed to the shaft deflector housing (142) but is capable of some radial movement relative to the shaft deflector housing (142), in order to facilitate operation of the biasing device (174).

As depicted in FIG. 6, the resilient material is distributed around the entire circumferential space between the shaft deflector housing (142) and the cam (144). As a result, in the second exemplary embodiment, the biasing device (174) also provides a sealing function between the shaft deflector housing (142) and the cam (144) so that the cam seal (147) may possibly be eliminated in the second exemplary embodiment. In variations of the second exemplary embodiment, the resilient material may be distributed over only a portion of the circumferential space between the shaft deflector housing (142) and the cam (144), or may be circumferentially positioned only directly opposite to the direction of the deflection of the shaft (96).

In the second exemplary embodiment, the adjustment range of the deflection adjusting mechanism (170) is dependent in part upon the range of travel of the resilient material. In the second exemplary embodiment, the deflection adjusting mechanism (170) comprises an adjustment limiter (178) for limiting the minimum adjusted deflection of the shaft (96). As depicted in FIG. 6, the adjustment limiter (178) comprises a stop interposed between the shaft deflector housing (142) and the cam (144) which prevents over-compression of the resilient material and which ensures that a minimum amount of deflection of the shaft (96) will be maintained during use of the drilling apparatus (90). As depicted in FIG. 6, the stop is provided on the shaft deflector housing (142), but the stop may alternatively be provided on the cam (144).

Figure 7:
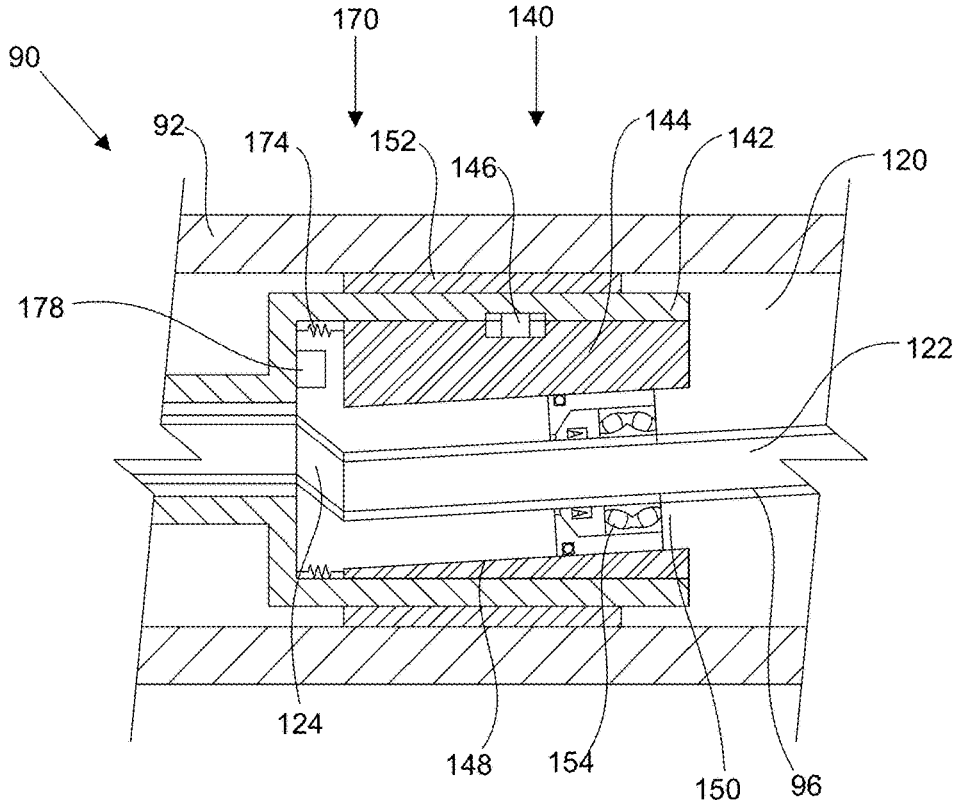
FIG. 7 is a longitudinal section schematic view of a third exemplary embodiment of a deflection adjusting mechanism for use in the drilling apparatus depicted in FIGS. 3A and 3B, wherein the deflection adjusting mechanism comprises a spring as a biasing device, interposed longitudinally between a shaft deflector housing and a cam.

Referring to FIG. 7, in the third exemplary embodiment of the deflection adjusting mechanism (170), the biasing device (174) comprises a suitable spring interposed longitudinally between the shaft deflector housing (142) and the cam (144) so that the external force exerted on the shaft (96) deforms the spring and causes the cam (144) to move longitudinally relative to the shaft deflector housing (142), thereby moving the deflection bearing (154) laterally in order to adjust the deflection of the shaft (96) and provide an adjusted deflection of the shaft (96). The spring is selected to provide a desired deformation in response to the magnitude of the axial force component which is exerted on the cam (142) by the deflection bearing (154) as a result of the external force which is expected to be exerted on the shaft (96) during use of the drilling apparatus (90). In the third exemplary embodiment, the cam retainer (146) connects the cam (144) with the shaft deflector housing (142) so that the cam (144) is rotationally fixed to the shaft deflector housing (142) but is capable of some axial movement relative to the shaft deflector housing (142), in order to facilitate operation of the biasing device (174).

As depicted in FIG. 7, one or more springs are distributed around all of the circumferential space between the shaft deflector housing (142) and the cam (144) to inhibit the cam (144) from tilting relative to the shaft deflector housing (142). In variations of the third exemplary embodiment, one or more springs may be distributed over only a portion of the circumferential space between the shaft deflector housing (142) and the cam (144).

In the third exemplary embodiment, the adjustment range of the deflection adjusting mechanism (170) is dependent in part upon the range of travel of the spring. In the third exemplary embodiment, the deflection adjusting mechanism (170) comprises an adjustment limiter (178) for limiting the minimum adjusted deflection of the shaft (96). As depicted in FIG. 7, the adjustment limiter (178) comprises a stop interposed between the shaft deflector housing (142) and the cam (144) which prevents over-compression of the spring and which ensures that a minimum amount of deflection of the shaft (96) will be maintained during use of the drilling apparatus (90). As depicted in FIG. 7, the stop is provided on the shaft deflector housing (142), but the stop may alternatively be provided on the cam (144).

Figure 8:
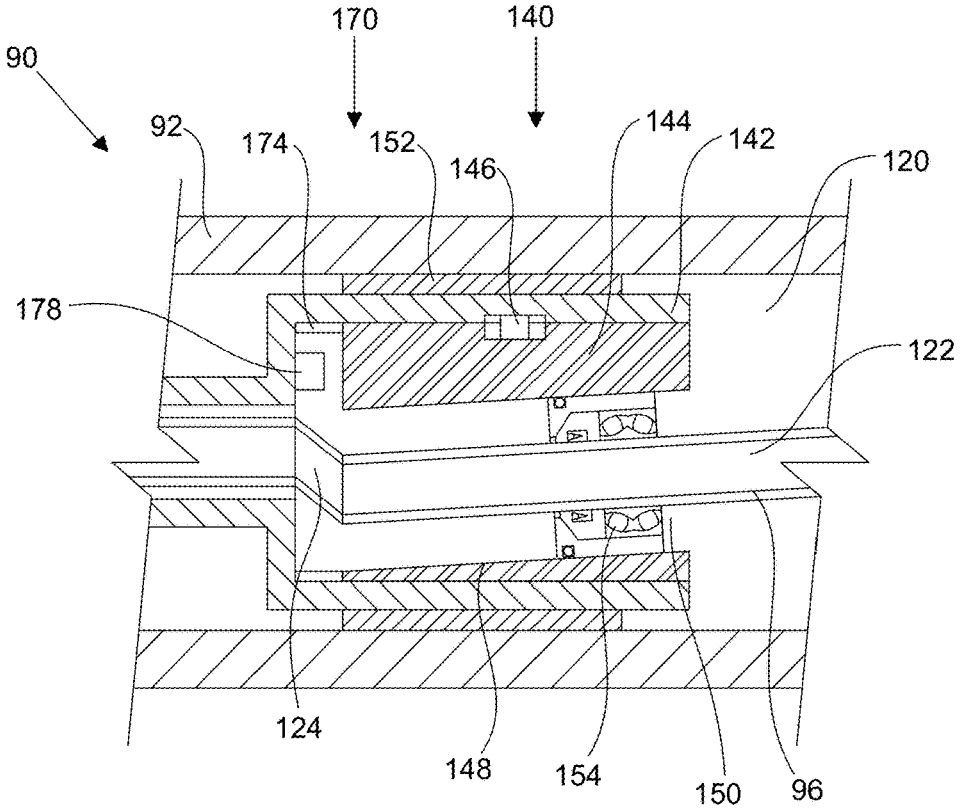
FIG. 8 is a longitudinal section schematic view of a fourth exemplary embodiment of a deflection adjusting mechanism for use in the drilling apparatus depicted in FIGS. 3A and 3B, wherein the deflection adjusting mechanism comprises a resilient material as a biasing device, interposed longitudinally between a shaft deflector housing and a cam.

Referring to FIG. 8, in the fourth exemplary embodiment of the deflection adjusting mechanism (170), the biasing device (174) comprises a suitable resilient material interposed longitudinally between the shaft deflector housing (142) and the cam (144) so that the external force exerted on the shaft (96) deforms the resilient material and causes the cam (144) to move longitudinally relative to the shaft deflector housing (142), thereby moving the deflection bearing (154) laterally in order to adjust the deflection of the shaft (96) and provide an adjusted deflection of the shaft (96). The resilient material is selected to provide a desired deformation in response to the magnitude of the axial force component which is exerted on the cam (142) by the deflection bearing (154) as a result of the external force which is expected to be exerted on the shaft (96) during use of the drilling apparatus (90). In the fourth exemplary embodiment, the cam retainer (146) connects the cam (144) with the shaft deflector housing (142) so that the cam (144) is rotationally fixed to the shaft deflector housing (142) but is capable of some axial movement relative to the shaft deflector housing (142), in order to facilitate operation of the biasing device (174).

As depicted in FIG. 8, the resilient material is distributed around all of the circumferential space between the shaft deflector housing (142) and the cam (144) to inhibit the cam (144) from tilting relative to the shaft deflector housing (142). As a result, in the fourth exemplary embodiment, the biasing device (174) also provides a sealing function between the shaft deflector housing (142) and the cam (144)

so that the cam seal (147) may possibly be eliminated in the fourth exemplary embodiment. In variations of the fourth exemplary embodiment, the resilient material may be distributed over only a portion of the circumferential space between the shaft deflector housing (142) and the cam (144).

In the fourth exemplary embodiment, the adjustment range of the deflection adjusting mechanism (170) is dependent in part upon the range of travel of the resilient material. In the fourth exemplary embodiment, the deflection adjusting mechanism (170) comprises an adjustment limiter (178) for limiting the minimum adjusted deflection of the shaft (96). As depicted in FIG. 8, the adjustment limiter (178) comprises a stop interposed between the shaft deflector housing (142) and the cam (144) which prevents over-compression of the resilient material and which ensures that a minimum amount of deflection of the shaft (96) will be maintained during use of the drilling apparatus (90). As depicted in FIG. 8, the stop is provided on the shaft deflector housing (142), but the stop may alternatively be provided on the cam (144).

Figure 9:
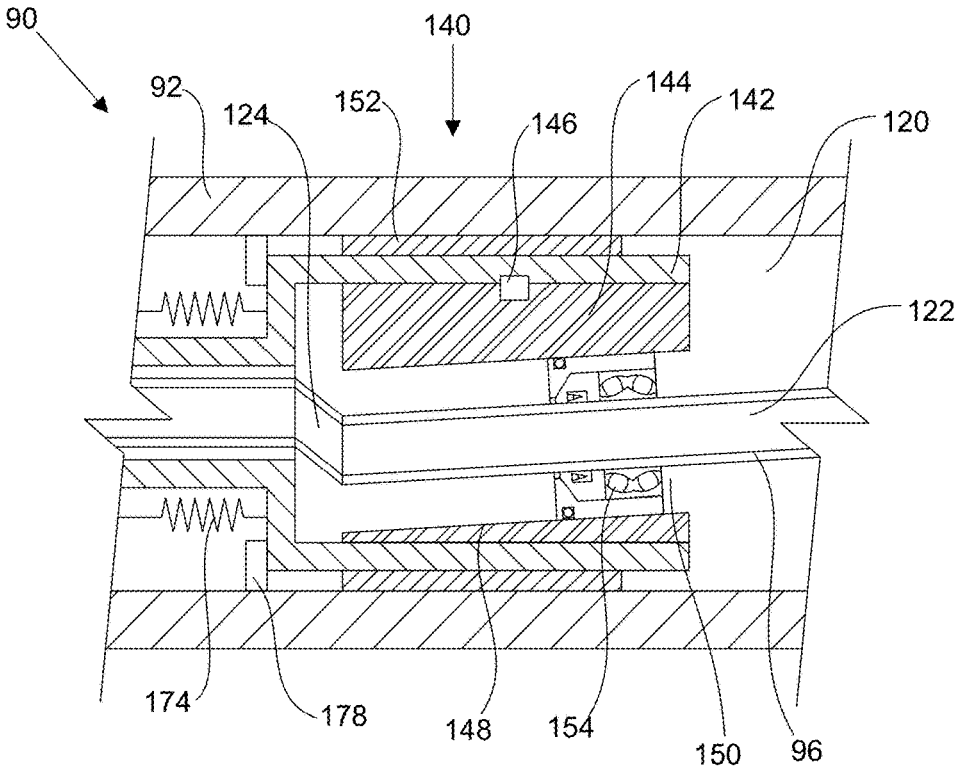
FIG. 9 is a longitudinal section schematic view of a fifth exemplary embodiment of a deflection adjusting mechanism for use in the drilling apparatus depicted in FIGS. 3A and 3B, wherein the deflection adjusting mechanism comprises a spring as a biasing device, interposed longitudinally between a shaft deflector housing and another component of the drilling apparatus.

Referring to FIG. 9, in the fifth exemplary embodiment of the deflection adjusting mechanism (170), the biasing device (174) comprises a suitable spring interposed longitudinally between the shaft deflector housing (142) and the housing (92) or another component of the drilling apparatus (90) so that the external force exerted on the shaft (96) deforms the spring and causes both the shaft deflector housing (142) and the cam (144) to move longitudinally within the drilling apparatus (90) relative to the shaft (92), thereby moving the deflection bearing (154) laterally in order to adjust the deflection of the shaft (96) and provide an adjusted deflection of the shaft (96). The spring is selected to provide a desired deformation in response to the magnitude of the axial force component which is exerted on the cam (142) by the deflection bearing (154) as a result of the external force which is expected to be exerted on the shaft (96) during use of the drilling apparatus (90). In the fifth exemplary embodiment, the cam retainer (146) connects the cam (144) with the shaft deflector housing (142) so that the cam (144) is both rotationally fixed and axially fixed to the shaft deflector housing (142), in order to facilitate operation of the biasing device (174).

As depicted in FIG. 9, one or more springs are distributed around the entire circumference of the shaft deflector housing (142) to inhibit the shaft deflector housing (142) from tilting within the housing (92). In variations of the fifth exemplary embodiment, one or more springs may be distributed around only a portion of the circumference of the shaft deflector housing (142).

In the fifth exemplary embodiment, the adjustment range of the deflection adjusting mechanism (170) is dependent in part upon the range of travel of the spring. In the fifth exemplary embodiment, the deflection adjusting mechanism (170) comprises an adjustment limiter (178) for limiting the minimum adjusted deflection of the shaft (96). As depicted in FIG. 9, the adjustment limiter (178) comprises a stop interposed between the shaft deflector housing (142) and the housing (92) which prevents over-compression of the spring and which ensures that a minimum amount of deflection of the shaft (96) will be maintained during use of the drilling apparatus (90). As depicted in FIG. 9, the stop is provided on the housing (92), but the stop may alternatively be provided on the shaft deflector housing (142).

Figure 10:
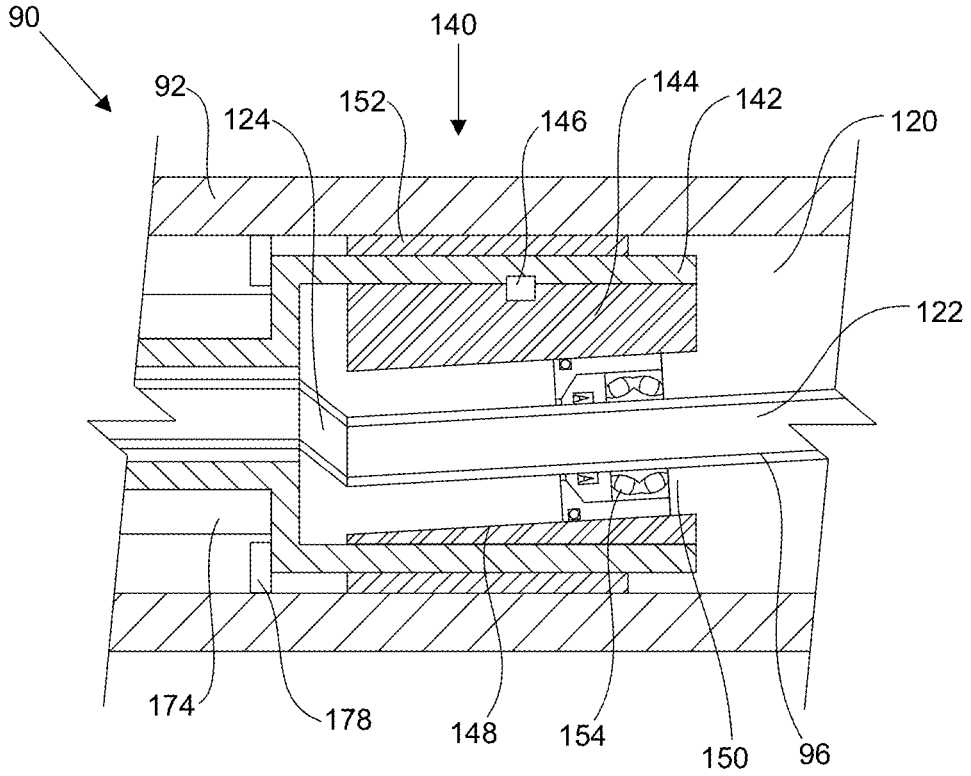
FIG. 10 is a longitudinal section schematic view of a sixth exemplary embodiment of a deflection adjusting mechanism for use in the drilling apparatus depicted in FIGS. 3A and 3B, wherein the deflection adjusting mechanism comprises a resilient material as a biasing device, interposed longitudinally between a shaft deflector housing and another component of the drilling apparatus.

Referring to FIG. 10, in the sixth exemplary embodiment of the deflection adjusting mechanism (170), the biasing device (174) comprises a suitable resilient material interposed longitudinally between the shaft deflector housing (142) and the housing (92) or another component of the drilling apparatus (90) so that the external force exerted on the shaft (96) deforms the resilient material and causes both the shaft deflector housing (142) and the cam (144) to move longitudinally within the drilling apparatus (90) relative to the shaft (92), thereby moving the deflection bearing (154) laterally in order to adjust the deflection of the shaft (96) and provide an adjusted deflection of the shaft (96). The resilient material is selected to provide a desired deformation in response to the magnitude of the axial force component which is exerted on the cam (142) by the deflection bearing (154) as a result of the external force which is expected to be exerted on the shaft (96) during use of the drilling apparatus (90). In the sixth exemplary embodiment, the cam retainer (146) connects the cam (144) with the shaft deflector housing (142) so that the cam (144) is both rotationally fixed and axially fixed to the shaft deflector housing (142), in order to facilitate operation of the biasing device (174).

As depicted in FIG. 10, the resilient material is distributed around the entire circumference of the shaft deflector housing (142) to inhibit the shaft deflector housing (142) from tilting within the housing (92). In variations of the sixth exemplary embodiment, the resilient material may be distributed around only a portion of the circumference of the shaft deflector housing (142).

In the sixth exemplary embodiment, the adjustment range of the deflection adjusting mechanism (170) is dependent in part upon the range of travel of the resilient material. In the sixth exemplary embodiment, the deflection adjusting mechanism (170) comprises an adjustment limiter (178) for limiting the minimum adjusted deflection of the shaft (96). As depicted in FIG. 10, the adjustment limiter (178) comprises a stop interposed between the shaft deflector housing (142) and the housing (92) which prevents over-compression of the spring and which ensures that a minimum amount of deflection of the shaft (96) will be maintained during use of the drilling apparatus (90). As depicted in FIG. 10, the stop is provided on the housing (92), but the stop may alternatively be provided on the shaft deflector housing (142).

In each of the exemplary embodiments, when an external lateral force is exerted on the deflected and/or tilted shaft (96) by a borehole or by some other source, the biasing device (174) will respond to the external lateral force, resulting in movement of the cam (144) and lateral movement of the deflection bearing (154), thereby reducing the deflection and/or tilting of the shaft (96) within the housing bore (120) and reducing the stresses experienced by the shaft (96).

In an apparatus which includes a shaft deflector (140) but does not include the deflection adjusting mechanism (170) as described herein, the deflection of the shaft (96) will be fixed during fabrication or assembly of the apparatus, or by the shaft deflector actuator (156) during assembly and/or use of the apparatus. In an apparatus which includes a shaft deflector (140) and also includes the deflection adjusting mechanism (170) as described herein, the deflection of the shaft (96) may be automatically adjusted without modification of the apparatus or use of the shaft deflector actuator (156) in order to manage the stresses experienced by the shaft (96).

In a drilling apparatus comprising a shaft deflector (140), events such as kickoff (using a bent shaft in a straight borehole) and reversed bending (using a downward bent shaft in an upward curved borehole) may cause the shaft (96) and other components of the drilling apparatus to experience significant stresses, which may reduce the life of the shaft (96) and the drilling apparatus. If the drilling apparatus also includes a deflection adjusting mechanism (170) as described herein, the deflection of the shaft (96) may be automatically and temporarily adjusted during events such as kickoff and reversed bending, which may reduce the risk of failure or excessive wear of the shaft (96) or other components of the drilling apparatus.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

ADDITIONAL DISCLOSURES

The following are non-limiting, specific embodiments of the apparatus described herein:

Embodiment A. An apparatus comprising:

(a) a housing defining a housing bore;

(b) a shaft extending within the housing bore, wherein the shaft is deflectable and tiltable within the housing bore;

(c) a fulcrum for tiltably supporting the shaft within the housing bore;

(d) a shaft deflector contained within the housing for providing a deflection of the shaft within the housing bore so that the shaft tilts about the fulcrum; and (e) a deflection adjusting mechanism comprising a biasing device which responds to an external force exerted on the shaft in order to adjust the deflection of the shaft provided by the shaft deflector, thereby providing an adjusted deflection of the shaft.

Embodiment B. The apparatus of Embodiment A wherein the shaft is connected with the housing such that the shaft is rotatable with the housing.

Embodiment C. The apparatus of Embodiment B, further comprising a shaft deflector bearing between the housing and the shaft deflector for rotatably supporting the shaft deflector within the housing, and further comprising a deflection bearing between the shaft deflector and the shaft for rotatably supporting the shaft within the shaft deflector, wherein the shaft deflector moves the deflection bearing in order to provide the deflection of the shaft.

Embodiment D. The apparatus of Embodiment A, further comprising a deflection bearing between the shaft deflector and the shaft for rotatably supporting the shaft within the shaft deflector, wherein the shaft deflector moves the deflection bearing in order to provide the deflection of the shaft.

Embodiment E. The apparatus of any one of Embodiments A through D wherein the deflection adjusting mechanism moves the deflection bearing in order to adjust the deflection of the shaft.

Embodiment F. The apparatus of Embodiment E wherein the deflection adjusting mechanism provides an adjustment range for the adjusted deflection of the shaft, and wherein the deflection of the shaft decreases within the adjustment range as the external force exerted on the shaft increases.

Embodiment G. The apparatus of Embodiment F wherein the adjustment range for the adjusted deflection of the shaft extends between a minimum adjusted deflection and a maximum adjusted deflection, further comprising an adjustment limiter for limiting the minimum adjusted deflection.

Embodiment H. The apparatus of any one of Embodiments A through G wherein the shaft deflector comprises a cam for providing the deflection of the shaft and wherein the deflection adjusting mechanism moves the cam in response to the external force exerted on the shaft in order to adjust the deflection of the shaft.

Embodiment I. The apparatus of Embodiment H wherein the deflection bearing is engaged with the cam so that the deflection bearing is moved laterally by the cam.

Embodiment J. The apparatus of Embodiment H or I wherein the shaft deflector comprises a shaft deflector housing and wherein the cam is positioned in the shaft deflector housing.

Embodiment K. The apparatus of Embodiment J wherein the deflection adjusting mechanism moves the cam laterally, thereby moving the deflection bearing laterally in order to adjust the deflection of the shaft.

Embodiment L. The apparatus of Embodiment K wherein the biasing device comprises a spring interposed radially between the shaft deflector housing and the cam so that the external force exerted on the shaft deforms the spring and causes the cam to move laterally relative to the shaft deflector housing.

Embodiment M. The apparatus of Embodiment K wherein the biasing device comprises a resilient material interposed radially between the shaft deflector housing and the cam so that the external force exerted on the shaft deforms the resilient material and causes the cam to move laterally relative to the shaft deflector housing.

Embodiment N. The apparatus of Embodiment J wherein the deflection adjusting mechanism moves the cam longitudinally, thereby moving the deflection bearing laterally in order to adjust the deflection of the shaft.

Embodiment O. The apparatus of Embodiment N wherein the biasing device comprises a spring interposed longitudinally between the shaft deflector housing and the cam so that the external force exerted on the shaft deforms the spring and causes the cam to move longitudinally relative to the shaft deflector housing.

Embodiment P. The apparatus of Embodiment N wherein the biasing device comprises a resilient material interposed longitudinally between the shaft deflector housing and the cam so that the external force exerted on the shaft deforms the resilient material and causes the cam to move longitudinally relative to the shaft deflector housing.

Embodiment Q. The apparatus of Embodiment N wherein the biasing device comprises a spring interposed longitudinally between the shaft deflector housing and another component of the apparatus so that the external force exerted on the shaft deforms the spring and causes the shaft deflector housing and the cam to move longitudinally within the apparatus.

Embodiment R. The apparatus of Embodiment N wherein the biasing device comprises a resilient material interposed longitudinally between the shaft deflector housing and another component of the apparatus so that the external force exerted on the shaft deforms the resilient material and causes the shaft deflector housing and the cam to move longitudinally within the apparatus.

Embodiment S. The apparatus of any one of Embodiments A through R wherein the apparatus is an apparatus for use in drilling a borehole.

Embodiment T. The apparatus of any one of Embodiments A through R wherein the apparatus is a rotary steerable drilling apparatus for use in drilling a borehole.

Embodiment U. The apparatus of any one of Embodiments A through R wherein the apparatus is a drilling motor for use in drilling a borehole.

I claim:

1. An apparatus comprising:

(a) a housing defining a housing bore;

(b) a shaft extending within the housing bore, wherein the shaft is deflectable and tiltable within the housing bore;

(c) a fulcrum for tiltably supporting the shaft within the housing bore;

(d) a shaft deflector contained within the housing for providing a deflection of the shaft within the housing bore so that the shaft tilts about the fulcrum;

(e) a deflection adjusting mechanism comprising a biasing device which responds to an external force exerted on the shaft in order to adjust the deflection of the shaft provided by the shaft deflector, thereby providing an adjusted deflection of the shaft; and (f) a deflection bearing between the shaft deflector and the shaft for rotatably supporting the shaft within the shaft deflector, wherein the shaft deflector moves the deflection bearing in order to provide the deflection of the shaft.

2. The apparatus as claimed in claim 1 wherein the shaft is connected with the housing such that the shaft is rotatable with the housing.

3. The apparatus as claimed in claim 2, further comprising a shaft deflector bearing between the housing and the shaft deflector for rotatably supporting the shaft deflector within the housing.

4. The apparatus as claimed in claim 1 wherein the deflection adjusting mechanism moves the deflection bearing in order to adjust the deflection of the shaft.

5. The apparatus as claimed in claim 4 wherein the deflection adjusting mechanism provides an adjustment range for the adjusted deflection of the shaft, and wherein the deflection of the shaft decreases within the adjustment range as the external force exerted on the shaft increases.

6. The apparatus as claimed in claim 5 wherein the adjustment range for the adjusted deflection of the shaft extends between a minimum adjusted deflection and a maximum adjusted deflection, further comprising an adjustment limiter for limiting the minimum adjusted deflection.

7. The apparatus as claimed in claim 4 wherein the shaft deflector comprises a cam for providing the deflection of the shaft and wherein the deflection adjusting mechanism moves the cam in response to the external force exerted on the shaft in order to adjust the deflection of the shaft.

8. The apparatus as claimed in claim 7 wherein the deflection bearing is engaged with the cam so that the deflection bearing is moved laterally by the cam.

9. The apparatus as claimed in claim 8 wherein the shaft deflector comprises a shaft deflector housing and wherein the cam is positioned in the shaft deflector housing.

10. The apparatus as claimed in claim 9 wherein the deflection adjusting mechanism moves the cam laterally, thereby moving the deflection bearing laterally in order to adjust the deflection of the shaft.

11. The apparatus as claimed in claim 10 wherein the biasing device comprises a spring interposed radially between the shaft deflector housing and the cam so that the external force exerted on the shaft deforms the spring and causes the cam to move laterally relative to the shaft deflector housing.

12. The apparatus as claimed in claim 10 wherein the biasing device comprises a resilient material interposed radially between the shaft deflector housing and the cam so that the external force exerted on the shaft deforms the resilient material and causes the cam to move laterally relative to the shaft deflector housing.

13. The apparatus as claimed in claim 9 wherein the deflection adjusting mechanism moves the cam longitudinally, thereby moving the deflection bearing laterally in order to adjust the deflection of the shaft.

14. The apparatus as claimed in claim 13 wherein the biasing device comprises a spring interposed longitudinally between the shaft deflector housing and the cam so that the external force exerted on the shaft deforms the spring and causes the cam to move longitudinally relative to the shaft deflector housing.

15. The apparatus as claimed in claim 13 wherein the biasing device comprises a resilient material interposed longitudinally between the shaft deflector housing and the cam so that the external force exerted on the shaft deforms the resilient material and causes the cam to move longitudinally relative to the shaft deflector housing.

16. The apparatus as claimed in claim 13 wherein the biasing device comprises a spring interposed longitudinally between the shaft deflector housing and another component of the apparatus so that the external force exerted on the shaft deforms the spring and causes the shaft deflector housing and the cam to move longitudinally within the apparatus.

17. The apparatus as claimed in claim 13 wherein the biasing device comprises a resilient material interposed longitudinally between the shaft deflector housing and another component of the apparatus so that the external force exerted on the shaft deforms the resilient material and causes the shaft deflector housing and the cam to move longitudinally within the apparatus.

18. The apparatus as claimed in claim 1 wherein the apparatus is an apparatus for use in drilling a borehole.

19. The apparatus as claimed in claim 1 wherein the apparatus is a rotary steerable drilling apparatus for use in drilling a borehole.

20. The apparatus as claimed in claim 1 wherein the apparatus is a drilling motor for use in drilling a borehole.

* * * * *